US008997401B2

(12) United States Patent
Kowalczyk et al.

(10) Patent No.: US 8,997,401 B2
(45) Date of Patent: Apr. 7, 2015

(54) BI-PARTING, BI-DIRECTIONAL DOOR SYSTEM

(71) Applicant: Stanley Black & Decker, Inc., New Britain, CT (US)

(72) Inventors: Thomas Michael Kowalczyk, Unionville, CT (US); Frank Howard Luke, Plainville, CT (US); John Andrew Nurse, Farmington, CT (US); Vinay Namabhai Patel, Berlin, CT (US)

(73) Assignee: Stanley Black & Decker, Inc., New Britain, CT (US)

( * ) Notice: Subject to any disclaimer, the term of this patent is extended or adjusted under 35 U.S.C. 154(b) by 0 days.

(21) Appl. No.: 13/903,353

(22) Filed: May 28, 2013

(65) Prior Publication Data

US 2014/0020298 A1 Jan. 23, 2014

Related U.S. Application Data

(60) Provisional application No. 61/672,813, filed on Jul. 18, 2012.

(51) Int. Cl.

| | |
|---|---|
| ***E05F 11/00*** | (2006.01) |
| ***E05F 15/14*** | (2006.01) |
| ***E05F 15/12*** | (2006.01) |
| *E05D 15/54* | (2006.01) |

(52) U.S. Cl.
CPC ..... *E05F 15/14* (2013.01); *E05F 15/127* (2013.01); *E05D 15/54* (2013.01)

(58) Field of Classification Search
USPC ..... 49/116, 118, 122, 326, 141, 366, 95, 49/96, 104, 105, 107, 108, 109, 110, 111, 49/112, 113, 114
See application file for complete search history.

(56) References Cited

U.S. PATENT DOCUMENTS

| | | | | |
|---|---|---|---|---|
| 2,242,706 | A * | 5/1941 | Hanson | 49/264 |
| 4,185,512 | A * | 1/1980 | Sommer | 74/411.5 |
| 5,332,279 | A * | 7/1994 | Golemis et al. | 296/146.4 |
| 7,143,547 | B2 | 12/2006 | Liles, Jr. | |
| 7,555,867 | B2 | 7/2009 | Liles, Jr. | |
| 7,946,079 | B2 * | 5/2011 | Brown | 49/139 |
| 8,167,020 | B2 * | 5/2012 | Shanahan et al. | 160/266 |
| 8,171,672 | B2 * | 5/2012 | Plavnik et al. | 49/334 |
| 8,205,387 | B2 * | 6/2012 | Ranaudo et al. | 49/141 |
| 8,448,997 | B2 * | 5/2013 | Laliberte et al. | 292/92 |

* cited by examiner

*Primary Examiner* — Jerry Redman
(74) *Attorney, Agent, or Firm* — Richard J. Veltman; Adan Ayala

(57) ABSTRACT

A door system includes two bi-parting, center-opening, bi-directional door panels disposed for counter-rotating swinging movement in a doorway. An operator is coupled to the door panels via a synchronizing system such that the door panels may be selectively opened in either direction relative to the doorway, and closed in the opposite direction, and such that the door panels swing through substantially equal angular distances. The synchronizing system may include a linkage, among other systems, and the operator may include an electro-mechanical operator, a mechanical door closer with spring, or a hybrid of both. A person may effect an emergency breakout by manually using a single-motion, low-force push against one of the door panels to simultaneously open both door panels.

20 Claims, 12 Drawing Sheets

BI-PARTING, BI-DIRECTIONAL DOOR SYSTEM

FIELD OF THE INVENTION

The present invention relates to door systems, and more particularly to a bi-directional door system using two door panels.

BACKGROUND OF THE INVENTION

A door exhibits physical properties which must be taken into account when providing a door system for a particular doorway. For example, a single swinging door panel will have a certain door edge velocity as a function of the width of the door. This is a factor which needs to be considered, for example, when ensuring that a person has exited the door swing path before causing the door to close. The width of the door panel also necessarily requires a predetermined operating envelope, which in turn determines the allowable proximity of other items to the door swing area. Furthermore, the door panel requires a certain operating kinetic energy to open. This is also a function of the width of the door and the mass of the door panel subassembly. As a result, it takes a certain minimum force to manually open such door panels in case of emergency, and in some cases, that force can be appreciable. Finally, if it is desired to use an automatic electro-mechanical door operator for this application, generally speaking, the larger the door, the more expensive the system components are likely to be. Also, the larger the door, the more susceptible it is to such environmental conditions as stack pressure (the pressure difference between ambient atmosphere, for example, and the air pressure of an interior space), and wind velocity.

If on the other hand it is proposed to use two doors with a center opening for a given doorway width to reduce edge speed, mass, door swing envelope, etc., problems arise if it is also proposed to operate both doors bi-directionally, especially automatically. Up to now, there has not been a satisfactory solution for synchronizing the bi-directional door swings of center-opening, bi-parting doors to open and close simultaneously through substantially equal angular distances so that a person may comfortably pass through the entire doorway in either direction, especially under automatic operation; nor has there been a solution in such situations for enabling a low-force, single-motion emergency breakout.

SUMMARY OF THE INVENTION

It has been discovered that it is actually possible to provide such a doorway with two center-opening, bi-parting door panels to reduce each door panel's edge velocity, mass, operating envelope, and operating kinetic energy, while also synchronizing the door panels for bi-directional movement, particularly if the doorway width is in the range of from 3 to 4 feet. It has also been discovered that such door panels can be driven automatically using electro-mechanical operators; or can be opened manually and closed using a mechanical door closer with spring; or by using a hybrid of the two, while still enabling a low-energy, single-motion manual breakout in case of emergency.

Accordingly it is an object of the present invention to provide a door system including two bi-parting, bi-directional door panels disposed for counter-rotating swinging movement in a doorway, in which a synchronizing system is operative to swing both door panels simultaneously selectively outwardly or inwardly of the doorway to open the door panels, and to close the door panels simultaneously, each door panel swinging through substantially equal angular distances.

It is a further object of the present invention to operate the door system either by an electro-mechanical operator, by manually opening with mechanical return, or by a hybrid of both.

It is yet another object of the present invention for a person to be able to manually open both door panels by a single-motion push against just one door panel.

It is still another object of the present invention for the synchronizing system to include a linkage system and a motion converter operatively associated with each door panel, where the linkage system includes first and second linkages, each defining a driven link, and each motion converter being drivingly connected to a respective door panel and being operative to convert the motion of respective driven links to rotary motion.

It is a further object of the present invention to include in each linkage a drive link pivotably connected to a connecting link, which in turn is pivotably connected to respective driven links, such that the links are located in the same plane, the drive and driven links of the first linkage remaining in parallel throughout the operation of the synchronizing system, and the connecting link of the second linkage being disposed at an angle to the connecting link of the first linkage, such that the driven link of the second linkage rotates in the opposite direction from the driven link of the first linkage.

It is another object of the present invention to include in the connecting links an adjuster for adjusting the lengths of the connecting links to accommodate variations in actual dimensions of the doorway and door panels.

It is a still further object of the present invention to include a gearbox in the motion converter, each gearbox including an output shaft drivingly connected to a respective door panel along an axis, the gearbox further including an input gear drivingly connected to a respective driven link and in drive engagement with an output gear for rotating the output shaft, the axis of the output gear being offset from the input gear towards a respective doorway side jamb so that the distance between the axis of rotation of the door panel and the side jamb is minimized.

It is another object of the present invention to select the gears to have a 1:2 motion multiplier, so that rotation of an operator output member through only 45 degrees of angular distance in either direction will cause the door panels to simultaneously swing through 90 degrees in either direction.

It is still another object of the present invention, if desired, to eliminate the gearbox to save cost, and to configure the linkage system to open the door panels by rotating them only in a single direction.

It is yet another object of the present invention to provide first and second door panels disposed for counter-rotating swinging movement in and out of a doorway and a header having a predetermined height disposed in an upper portion of the doorway, the header including first and second door panel pivot members extending downwardly from the header adjacent first and second ends of the header, where the door panels are drivingly connected to, and pivotable about, respective door panel pivot members, and a synchronizing system disposed in the header and operative to swing the door panels simultaneously selectively outwardly or inwardly of the doorway through substantially equal angular distances.

It is still another object of the present invention to dispose an electro-mechanical operator and its controller in the header such that the operator output member is disposed intermediate the ends of the header and is rotatably coupled to the synchronizing system.

It is a further object of the present invention to include a linkage system in the synchronizing system, and a drive disk coupled to the operator output member, the drive disk including two drive links and an adjuster for adjusting the amount of travel of the drive disk such that the amount of door opening swing can be varied from 90 degrees to 110 degrees in either direction.

It is a still further object of the present invention for the synchronizing system to include two spaced-apart mechanically-coupled electro-mechanical operators disposed in the header, where only one of the operators includes a motor.

It is another object of the present invention to minimize the height of the header by using a synchronizing system in which an electro-mechanical operator and controller are disposed axially on one of the side jambs or door panels, the operator being drivingly coupled to respective door panel pivot members extending downwardly from the header.

It is yet another object of the present invention to use a mechanical door closer or operator with spring disposed in the header in place of the electro-mechanical operator, such that the door panels can be manually opened by a person, and are closed by the mechanical operator.

It is a still further object of the present invention to use in the header a hybrid of an electro-mechanical operator and a mechanical operator with spring, in place of the electro-mechanical operator, to combine the opening advantages of an electro-mechanical operator with the damped closing action of a mechanical operator with spring, the two operators being mechanically coupled through a dog clutch system, such that a person manually opening the door panels will not back-drive the electro-mechanical operator, but where the electro-mechanical operator can still be used to open the door panels, and the mechanical operator to close them.

It is another object of the present invention to provide a method for synchronizing the opening and closing of two bi-parting, center-opening, bi-directional door panels by linking the door panels for simultaneous rotation about respective pivots disposed adjacent respective sides of a doorway such that the door panels may be opened selectively in either direction in relation to the doorway, whereby when the door panels are opened, the door panels rotate simultaneously through substantially equal angular distances, and whereby, when the door panels are closed, the door panels rotate simultaneously through substantially equal angular distances.

It is yet another object of the present invention to provide a method for minimizing the door opening force for two bi-parting swinging door panels by synchronizing the swings of both panels using a linkage system such that the door panels simultaneously selectively open and close through substantially equal angular distances, and coupling the linkage system to a rotatable output member of a door operator such that rotation of the output member through a predetermined angular distance results in simultaneous swings of the door panels through an angular distance of about twice the door output member angular rotation, whereby the door opening force lies in the range of from about two pounds to about five pounds.

It is a further object of the present invention to provide a low-force door system which requires reduced door torque under such environmental conditions as stack pressure and wind, which yields a reduced open time, is center-opening, which employs a rigid synchronizing system indicative of a high-quality door system, which is readily adaptable to retrofitting in a single-door opening, and which provides a compact and robust system that minimizes cost.

Other features and advantages of the present invention will become apparent from the following description when viewed in accordance with the accompanying drawings and appended claims.

DETAILED DESCRIPTION OF THE PREFERRED EMBODIMENTS

Figure 1:
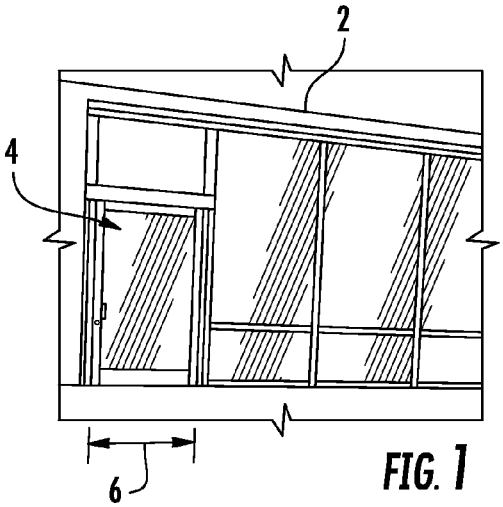
FIG. 1 is an elevational view of a single-panel entrance door for an office.
Figure 2:
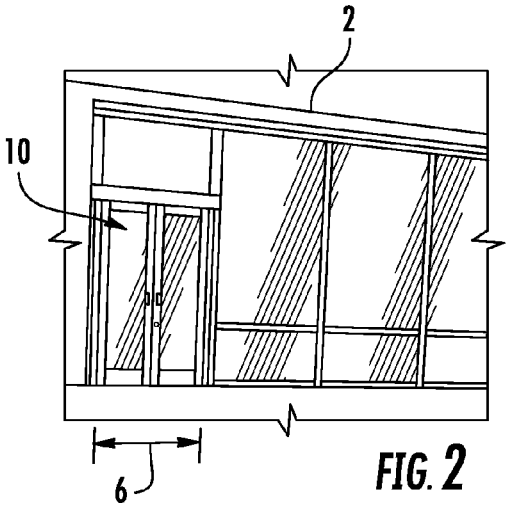
FIG. 2 is an elevational view of the door opening of FIG. 1 retrofitted with a door system of the present invention.
Figure 3:
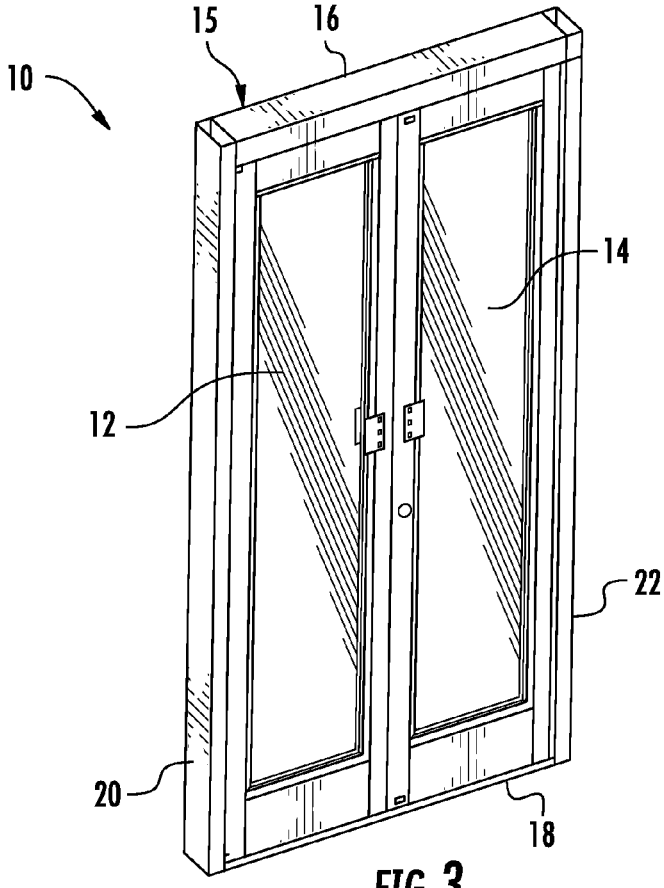
FIG. 3 is a perspective view of one embodiment of a door system of the present invention.

FIG. 1 shows a typical door application, namely in this case an office space 2, using a conventional single-panel door 4 disposed in a doorway 6 having a predetermined width. As previously noted, the door 4 exhibits various mechanical properties, such as mass, door edge velocity, width, and operating envelope, and is subject to such environmental conditions as stack load and wind speed. Furthermore, if the door 4 is equipped with an electromechanical or mechanical door operator, it would require a certain breakout force for a person to manually open the door in case of an emergency. If the doorway width is in the range of from about three feet to about four feet, it becomes a perfect opportunity to retrofit the doorway 6 with a low-energy, bi-parting, center-opening, bi-directional door system 10 according to the present invention, as shown in FIG. 2. That means that now the door swing envelope of a door panel of the door system 10 of the present invention can be as little as seventeen inches. Accordingly, by employing half-width door panels, the physical properties of the door panel and the effects upon the door panel of environmental conditions have been reduced by at least half. However, until the discovery of the door system 10 of the present invention, this approach would itself have generated several other problems.

For example, how can it be ensured that a person who manually opens the door system 10 has only to push one panel to swing both of them outwardly (or inwardly, depending upon the direction of travel), and that they both move simultaneously through substantially equal angular distances? Generally speaking, in a small-width doorway, the person would like to see that the full doorway is available to pass through, and that it wouldn't be necessary to contend with one door panel moving independently of the other. And how are these objects accomplished when the door system 10 is automatic, using an electro-mechanical door operator responsive to activation both by people entering and exiting the office space 2, so that the door panels can move simultaneously both inwardly and outwardly to open the door, and vice-versa, to close the door? And finally, how can it be ensured that in case of emergency, a person need apply only a minimum of breakout force using a single motion against one panel to exit the space?

The door system 10 of the present invention solves these problems, as will be described below. In the meantime, it should be appreciated that the application of the door system 10 of the present invention is not limited to small doorways, nor to retrofit opportunities.

Figure 4:
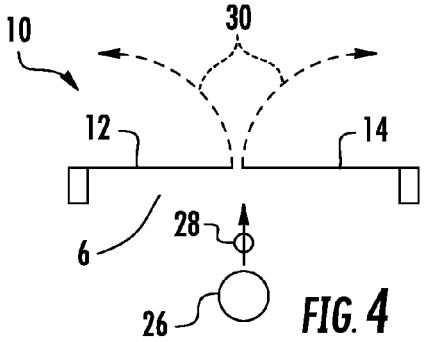
FIG. 4 is a schematic view of a door system of the present invention in which the door panels open by swinging outwardly of the doorway, where the direction of approach by a person is from one direction.
Figure 5:
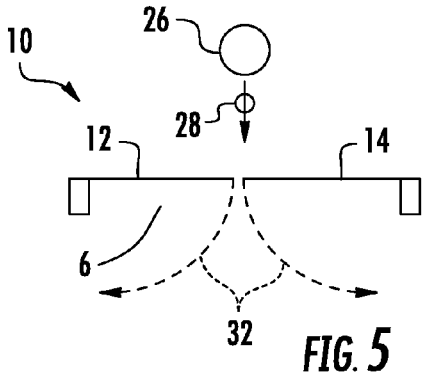
FIG. 5 is a view similar to FIG. 4, in which the door panels open by swinging inwardly of the doorway, where the direction of approach by a person is from the opposite direction.
Figure 6:
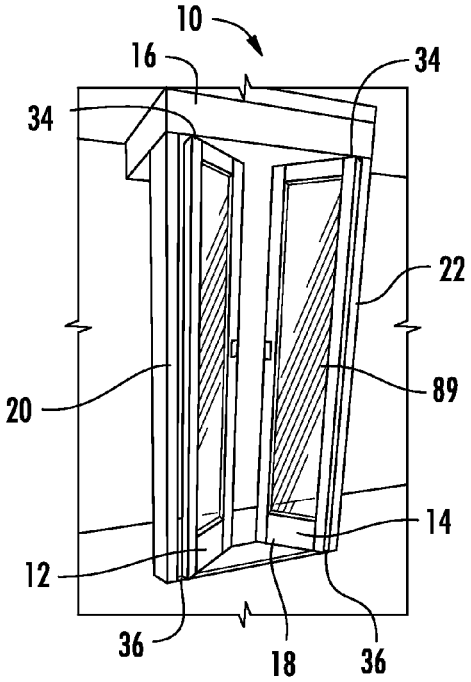
FIG. 6 is an elevational view of a door system of the present invention, in which the door panels are opening in one direction.
Figure 7:
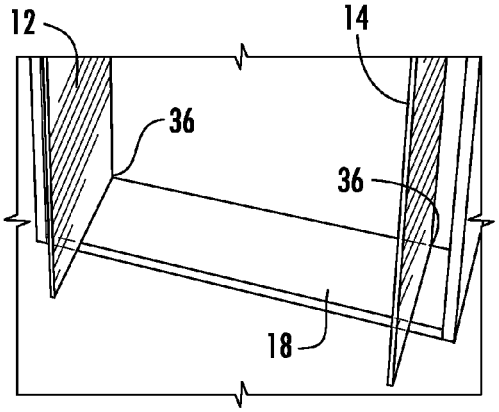
FIG. 7 is a partial elevational view of a door system of the present invention, in which the door panels have opened in the opposite direction.
Figure 8:
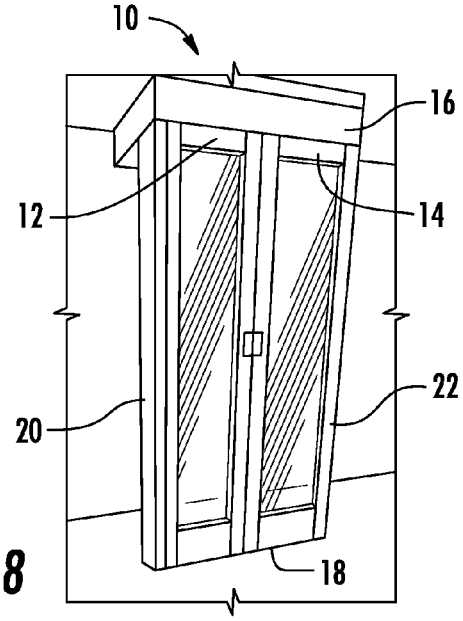
FIG. 8 is an elevational view of a door system of the present invention, in which the door panels have closed.
Figure 9:
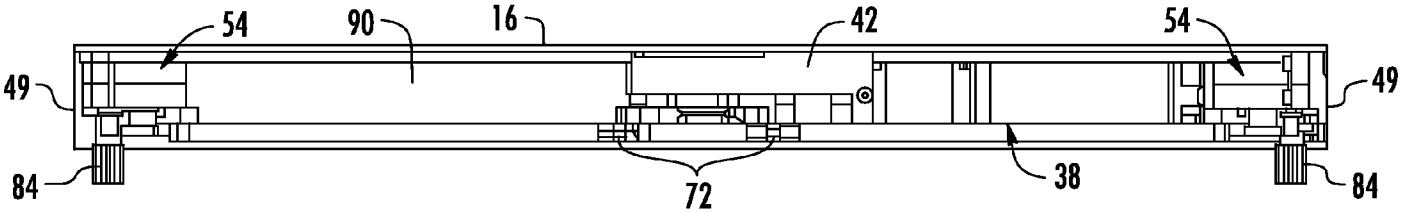
FIG. 9 is a side elevational detail view of a header subassembly (with cover partially removed) of a door system of the present invention, illustrating an electro-mechanical operator (or drive), controller and synchronizing system of the present invention.
Figure 10:
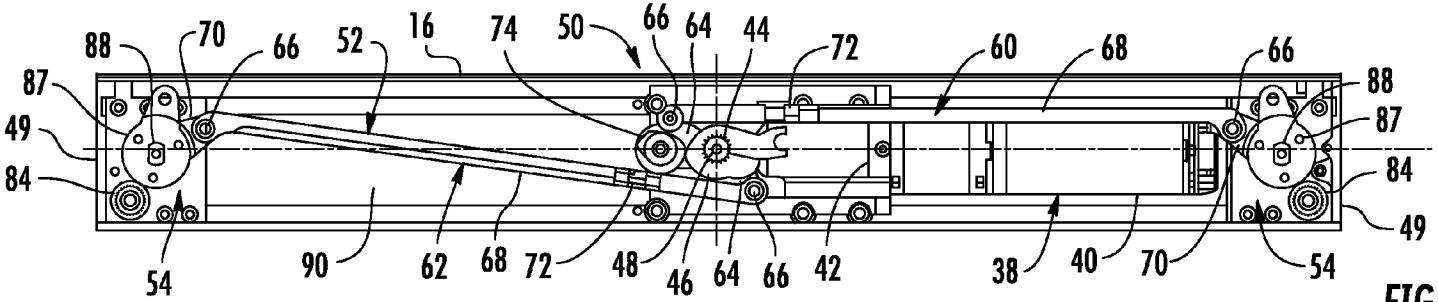
FIG. 10 is a bottom plan view of the header subassembly of FIG. 9, further illustrating linkage and motion conversion systems making up a synchronizing system of the present invention, in which the linkage system is in the closed or "home" position.
Figure 11:
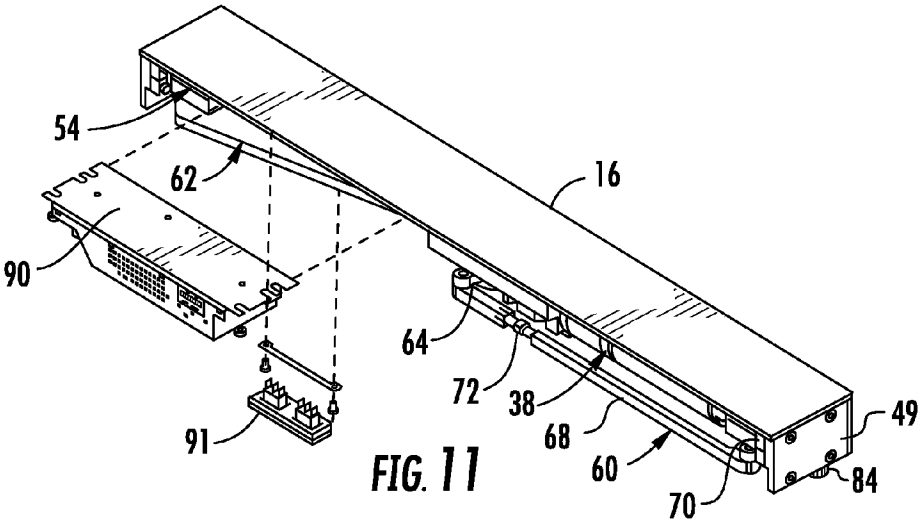
FIG. 11 is a perspective view of the header subassembly of FIGS. 9 and 10, showing elements of the first and second linkages of the present invention.

The external elements of the door system 10 of the present invention, and its basic operation, are illustrated in FIGS. 3-8. First and second bi-parting, center-opening door panels 12, 14 are disposed in frame 15 in doorway 6 for counter-rotating, bi-directional swinging movement. Frame 15 includes a header 16 extending across the width of both panels 12, 14, a threshold 18, and first and second side jambs 20, 22. As will be described later, the door system 10 of the present invention is able to locate the side edges of the panels 12, 14 practically right against respective side jambs 20, 22 to maximize the full use of the width of doorway 6. Referring now to FIGS. 4 and 5, as a person 26 moves towards the doorway 6 from either direction along the direction of approach 28, and opens the panels 12, 14 either manually or by activating an electro-mechanical operator, the panels 12, 14 swing simultaneously outwardly or inwardly of the doorway 6 through substantially equal angular distances or door swings 30, 32. As they do so, as shown in FIGS. 6-8, they pivot about upper and lower door panel pivot members 34, 36 disposed adjacent the ends of header 16 and threshold 18, respectively. The lower door panel pivot members 36 may be, for example, axially mounted in the threshold 18, or may be disposed in the side jambs 20, 22 with a portion extending axially upwardly. Details of the arrangement and operation of the upper door panel pivot members 34 will be described next, in conjunction with an explanation of the operation of the other elements of the door system 10 of the present invention.

FIGS. 9-21 illustrate internal elements of one embodiment of a door system 10 of the present invention, which are all contained within header 16, the height of which is minimized so that the door system 10 of the present invention may be readily retrofitted into a single-door application, as illustrated in FIGS. 1 and 2. For example, in the application of the door system 10 of the present invention to a three-foot doorway 6, the height of header 16 is about three inches and its length is about 36 inches. Referring first to FIGS. 9-14, elements of a door system 10 using an electro-mechanical operator assembly are illustrated. Such an operator assembly or drive 38 includes a motor 40 electrically connected to a source of electrical power (not shown). The motor 40 is drivingly connected to a transmission 42, which in turn rotates an operator output member 44 through a predetermined angular distance. In one embodiment of the door system 10 of the present invention, this distance is 45 degrees in either direction, for a total of 90 degrees of rotation. Also in one embodiment of the door system 10 of the present invention, the motor is a 3/16 HP D.C. motor, the transmission 42 includes a planetary gear system, and the overall speed reduction achieved by these components is about 125 to 1. One illustration of such a planetary transmission and motor for a door system is found in U.S. Pat. No. 6,530,178, issued Mar. 11, 2003 to Kowalczyk et al., the entirety of which patent is hereby incorporated by reference into the present application.

The operator output member 44 is drivingly connected to a drive disk 46 via splined connections 45, details of which are shown in FIGS. 15-19 and will be more thoroughly described later. However, the rotational axes 48 of the operator output member 44 and drive disk 46 are made coincident, and are located intermediate the ends 49 of the header 16, preferably in the center, to maximize the balance and alignment of the rest of the system, and to minimize the stresses on the link members discussed below.

Figure 12:
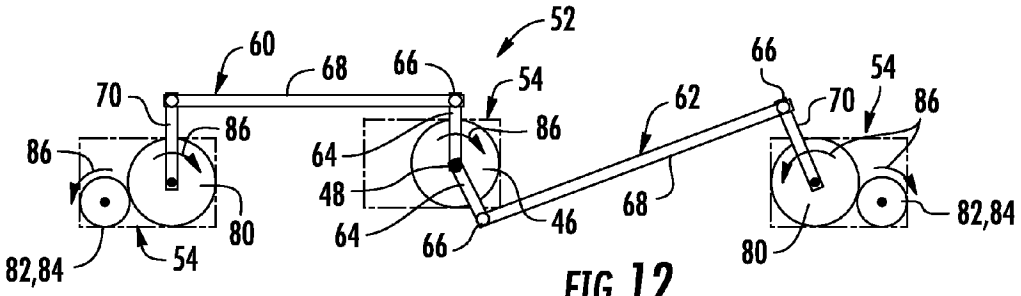
FIG. 12 is a schematic view of a synchronizing system of the present invention with the door panels in the home or closed position, illustrating the coaction of first and second linkages of the present invention with both the output member of an operator and with the motion conversion systems of the present invention.
Figure 13:
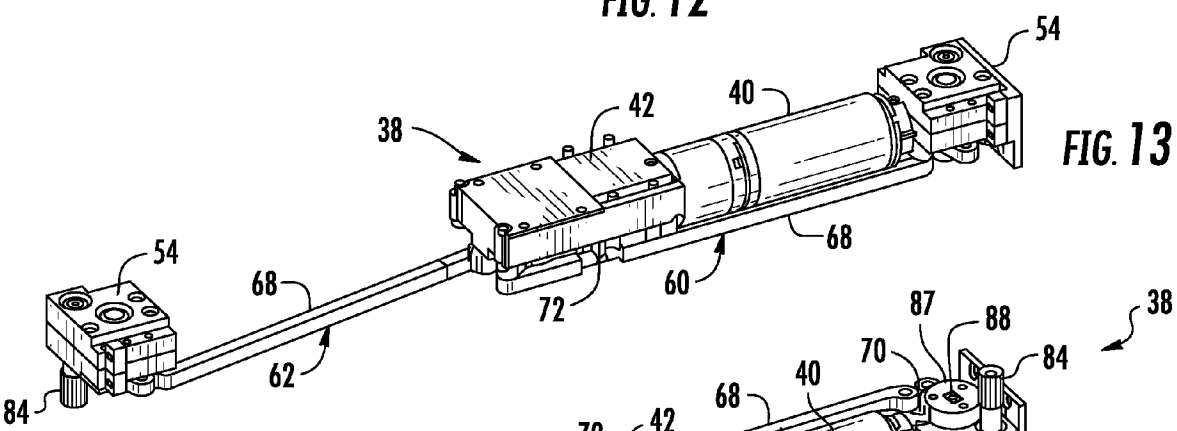
FIG. 13 is perspective view, taken from above, of an operator and synchronizing system subassembly of the present invention, also with the door panels in the home position, illustrating the respective relationships among the linkages and gearboxes of the present invention and an electro-mechanical operator of the present invention.
Figure 14:
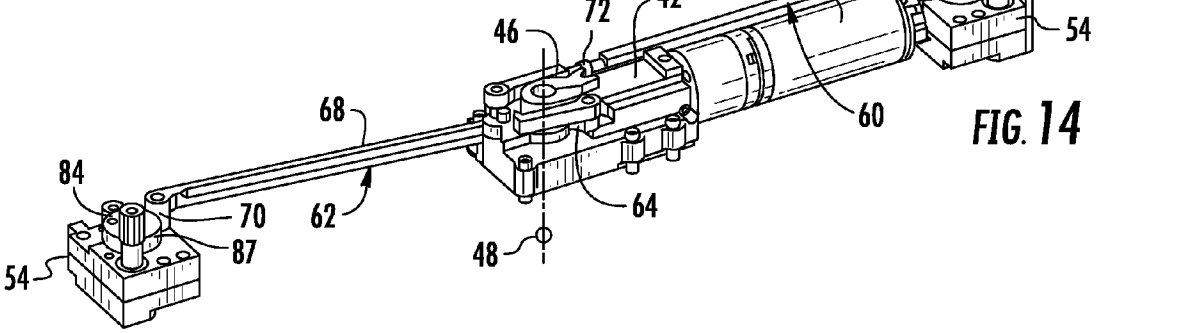
FIG. 14 is a perspective view of the subassembly of FIG. 13, taken from below.
Figure 15:
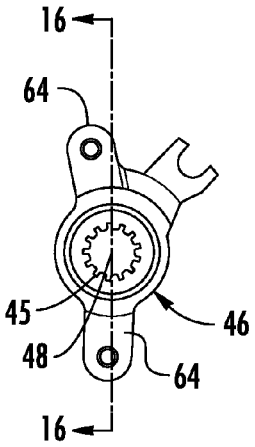
FIG. 15 is a top plan detail view of a drive disk of the present invention.
Figure 16:
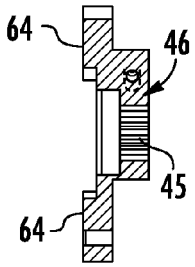
FIG. 16 is a sectional view, taken along line 16-16 of FIG. 15.
Figure 17:
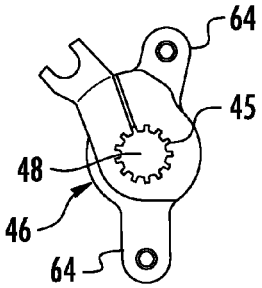
FIG. 17 is a bottom plan view of the drive disk of FIG. 15.

The door system 10 of the present invention also includes a synchronizing system 50 operative to swing both panels 12, 14 simultaneously selectively outwardly or inwardly of the doorway to open the door panels, and to close the door panels simultaneously, each door panel 12, 14 swinging through substantially equal angular distances. In this embodiment of the door system 10 of the present invention, the synchronizing system 50 includes a linkage system 52 drivingly connected to the drive disc 46. The synchronizing system 50 also includes motion converters 54 drivingly connected to the linkage system 52 and disposed adjacent respective ends 49 of header 16. Motion converters 54 are operative to convert the motion of the linkage system 52 to rotary motion. The linkage system 52 includes first and second linkages 60, 62, each of which includes a driver link 64 disposed on opposite sides of the drive disk 46. Linkages 60, 62 further include connecting links 68 pivotably connected to driver links 64 via pivots 66, and to driven links 70, via similar pivots 66. To conserve height and to maintain simplicity, all of the links 64, 68, 70 lie in the same plane. As schematically shown in FIG. 12, the linkages 60, 62 are so arranged that the driver and driven links 64, 70 of the first linkage 60 remain in parallel throughout the operation of the first linkage, and the connecting link 68 of the second linkage 62 lies at an angle to the connecting link of the first linkage. This arrangement causes the direction of rotation (as shown by arrows 86) of the driven link 70 of the second linkage 62 to be opposite to the direction of rotation of the driven link 70 of the first linkage 60. And that's how the counter-rotation of the door panels 12, 14 is effected. In one embodiment of the door system 10 of the present invention disposed in a three-foot-wide doorway, it has been found that the optimum length of each connecting link 68 is in the range of from about 14.75 in. to about 15.00 in., and the length of each driver and driven link 64, 70 is about 2.75 in., such that the ratio of the lengths of the connecting links to the driver/driven links is about 5½ to 1. The result is a rigid system that swings the doors simultaneously, as contrasted to a system using a flexible coupling, in which the door panels may move independently of one another due to the inherent slop in such a system.

Also in one embodiment of the door system 10 of the present invention, the connecting links 68 are formed in two parts, each part threadedly connected by an adjusting stud 72, so that the lengths of the connecting links may be adjusted in the field to accommodate such things as variations in doorway dimensions and in tolerances in the synchronizing system 50.

Figure 18:
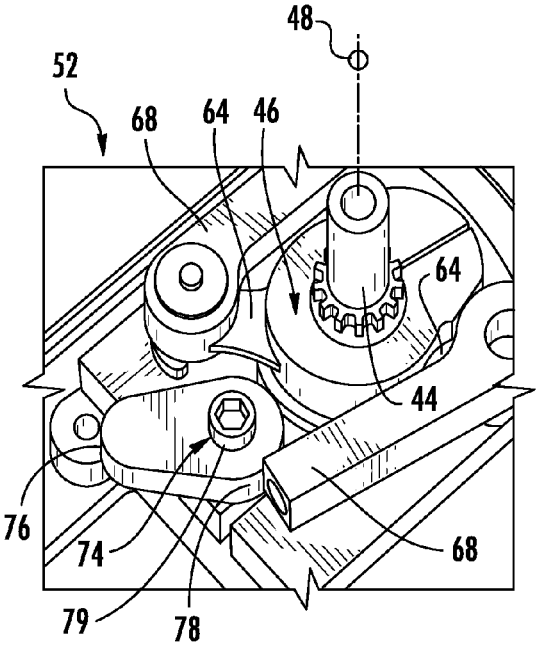
FIG. 18 is a perspective detail view of the coaction of an output member, drive disk and adjustable stop of the present invention, in which the adjustable stop is set for a door opening swing of 90 degrees.
Figure 19:
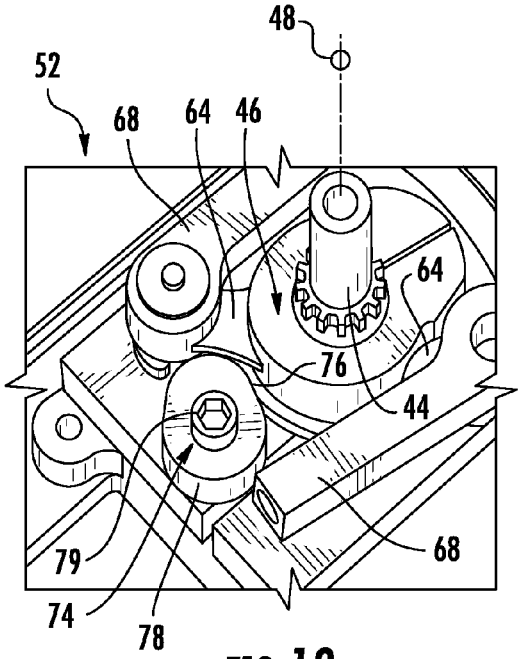
FIG. 19 is a view similar to FIG. 18, in which the stop is set for a door opening swing of 110 degrees.

Referring now to FIGS. 15-19, the linkage system 52 may also include a system for adjusting the amount of swing of the door panels 12, 14. An adjustable stop member 74 having a cam portion 76 and a round portion 78 is mounted adjacent the drive disk 46. The stop member 74 may be rotated to present such portions at various attitudes to a driver link 64 of the drive disk 46, and can be retained in a selected position by screw 79, about which it rotates. The "open" stop limits the door panel swing by limiting the rotation of the drive disk 46 (via driver link 64). In one embodiment of the door system of the present invention, the cam portion 76 can be adjusted to allow a full open position in the range of from 90 degrees to 110 degrees in the out-swing direction. Inasmuch as the opposite side of the stop is round, the round portion 78 provides a fixed 90 degrees stop in the in-swing position. FIG. 18 shows the stop in the 90 degrees position, while FIG. 19 shows the stop in the 110 degrees position.

Referring to FIGS. 20 and 21, and once again to FIGS. 9-14, the coaction of the linkage system 52 with the motion converter system 54 of the present invention is illustrated. In this embodiment, the motion converter system 54 includes a gearbox (also numbered 54) including an input gear 80 having an axis 81 and drivingly connected to an output gear 82, which defines an axis 83 offset in the direction of a side jamb 20, 22 from the axis 81 of the input gear. The output gear 82 in turn includes a splined output shaft 84 (which also serves as the upper door panel pivot member 34, pivoting about axis 83), which drivingly engages a mating splined recess (not shown) in the upper portion of respective door panels 12, 14. The offset ensures that the axes of rotation 83 of respective door panels 12, 14 lie as closely as possible to the edges of respective side jambs 20, 22, thereby maximizing the use of available doorway space. In a preferred embodiment of the door system 10 of the present invention disposed in a three-foot doorway, it has been found that the optimum distance between respective splined output shaft pivot axes 83 is about 34 in., each being spaced about 1 in. from respective ends 49 of header 16.

Figure 21:
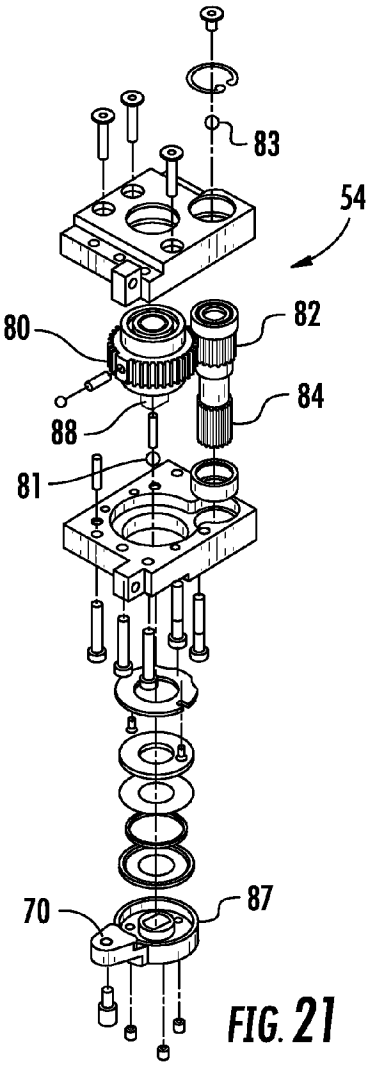
FIG. 21 is an exploded perspective detail view of the gearbox of FIG. 20, also showing its relationship to a driven link coupling member of the present invention.
Figure 20:
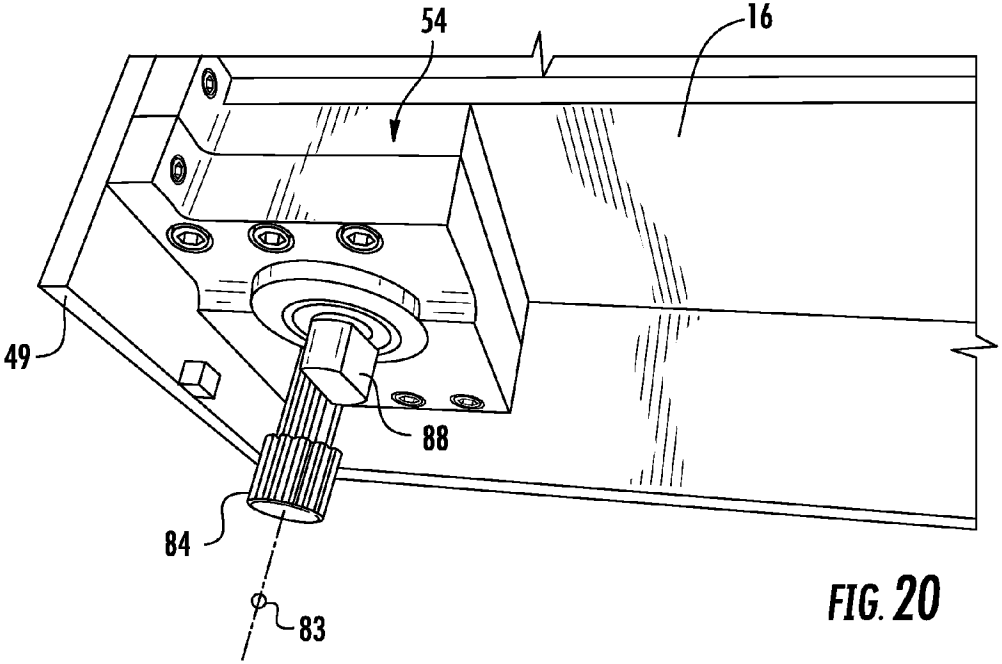
FIG. 20 is a perspective detail view of a gearbox according to the present invention.
Figure 22:
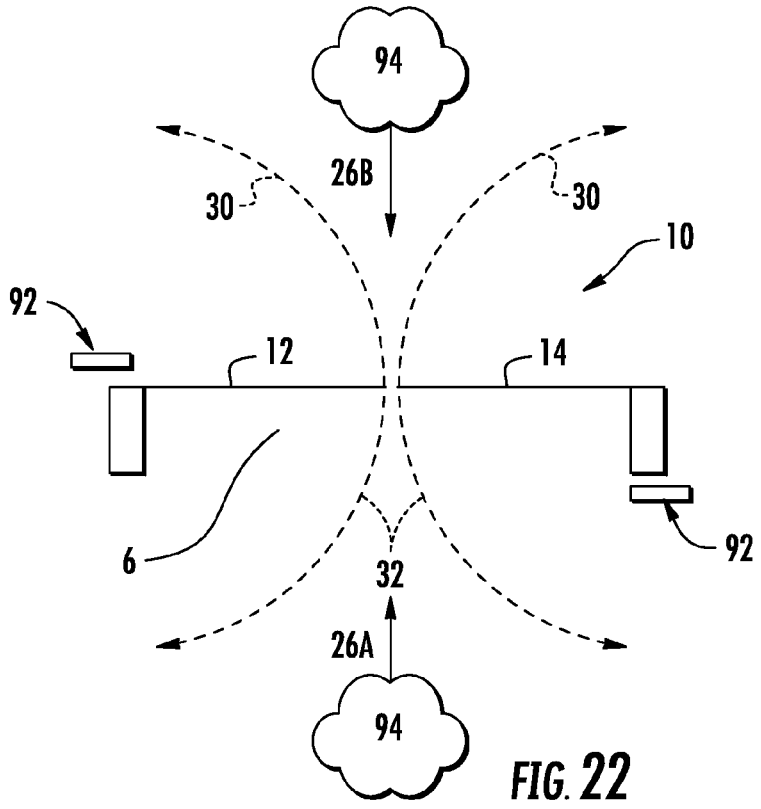
FIG. 22 is a schematic view of the relationship of door activation devices and safety sensors to the door panels of the present invention.
Figure 23:
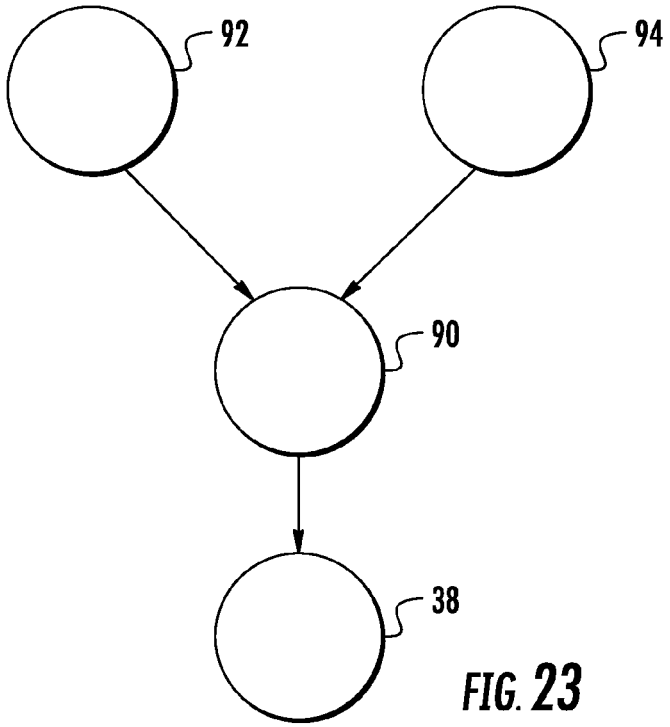
FIG. 23 is a schematic view of the relationship among activation devices, safety sensors, controller and electromechanical operator of the present invention.

Referring to FIG. 21, the driven links 70 are disposed on driven link coupling members 87, which in turn are drivingly coupled to input gears 80 via double-D drive members 88 extending downwardly from input gears 80. The gear ratio is selected to be 2:1, so that rotation of controller output member 44 through 45 degrees in either direction causes the door panels 12, 14 to rotate 90 degrees in either direction, via the linkages 60, 62. Thus, the controller output member 44 need only rotate through 90 degrees to achieve a total swing of 180 degrees of door panels 12, 14.

A further embodiment of the door system 10 of the present invention contemplates eliminating the gearbox 54 to further reduce the cost of the door system. In this embodiment, the linkages 60, 62 may be drivingly connected to a splined shaft similar to output shaft 84 in any suitable direct-drive fashion. However, inasmuch as there is no gear reduction, the door swings will be limited to 90 degrees, the maximum total rotation of output member 44. Accordingly, eliminating the gearbox 54 will mean that the door system 10 of the present invention will become uni-directional, namely swinging only outwardly to open, or only swinging inwardly to open, and vice-versa, to close.

Referring once more to FIGS. 9-11 and 22 and 23, a controller 90 is disposed in the header 16 and is electrically connected to the electro-mechanical operator 38. The controller controls the operation of operator 38 responsive to input signals from such elements as activation devices 92 and safety sensors in zones 94. In one embodiment, controller 90 is a Stanley Access Technologies controller, Model MC-521, which, as can be appreciated, can be readily modified by persons of ordinary skill in the art to cause the operator 38 to open door panels 12, 14 in both directions, instead of unidirectionally. If desired, controller 90 may also be modified by one of ordinary skill in the art to recognize that two people have entered zones 94 from opposite sides of the doorway 6, and, for example, to either allow the door panels 12, 14 to slowly rotate away from one of the approaching people; to provide a warning alarm and allow the doors to open; or not to allow any door motion.

At this point, it should be noted that the coaction of various elements of this embodiment of the door system 10 of the present invention allows a person to effect a low-force, single-motion breakout in the event of an emergency by simply pushing against a single panel 12, 14, which opens both panels simultaneously through substantially equal amounts of swing. In fact, internal tests of the door system 10 of the present invention in a three-foot doorway have shown that it only takes about two to three pounds of force to manually achieve the breakout. By comparison, doors which require five pounds of force to open are considered to be "light doors".

Figure 24:
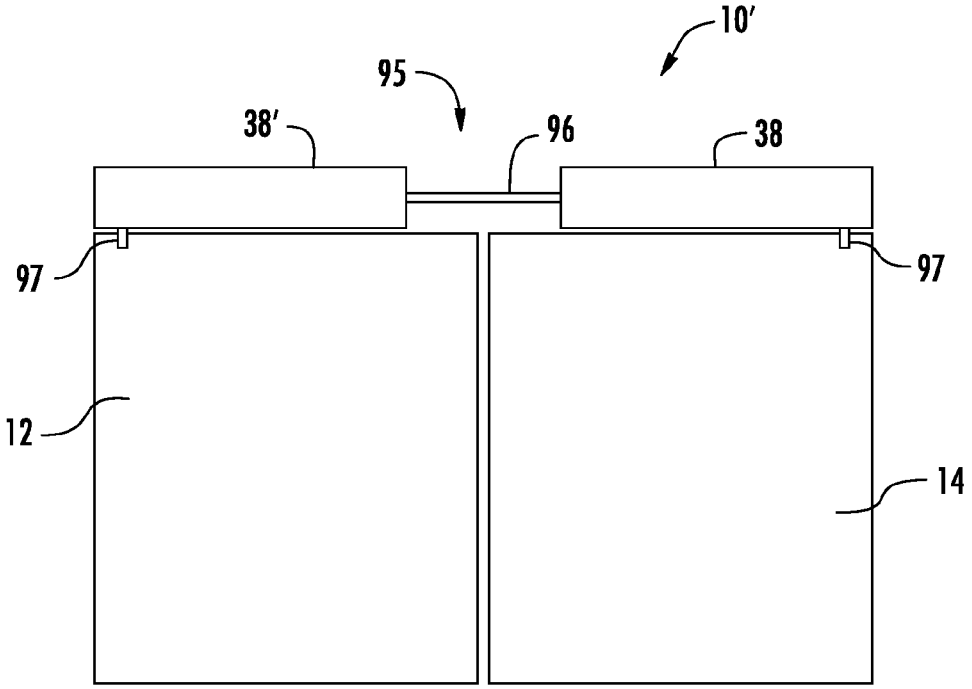
FIG. 24 is a schematic view of another embodiment of a door system of the present invention, showing a two-operator synchronizing system.
Figure 25:
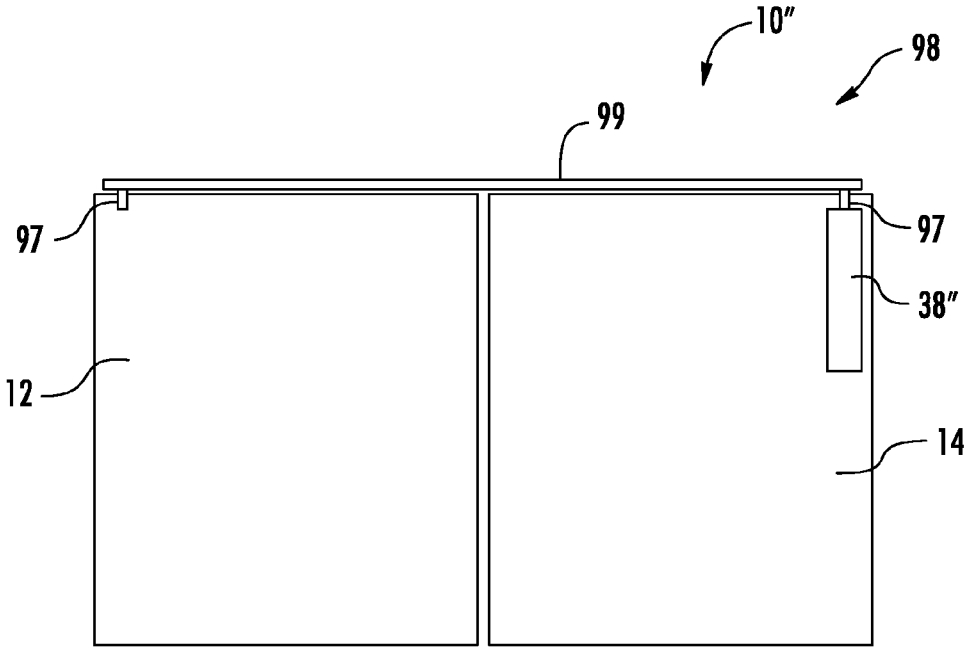
FIG. 25 is a schematic view of still another embodiment of a door system of the present invention, showing an axial operator synchronizing system.

Still further embodiments of the door systems 10' and 10" of the present invention are shown in FIGS. 24 and 25, respectively. In FIG. 24, the synchronizing system 50 has been replaced by a synchronizing system 95, which couples two electro-mechanical operators 38, 38' disposed in header 16 via rigid coupling 96, and in which operator 38' does not have a motor. Operators 38, 38' are in turn drivingly connected to door panels 12, 14 through respective splined output members/door panel pivots 97, similar to splined output shafts 84 in the previous embodiment.

If it is desired to minimize the height of header 16, an electro-mechanical operator 38" and its associated controller 90 may be disposed axially on one of the side jambs 20, 22, on a wall, or on a door panel 12, 14, as shown in FIG. 25, to create an axial synchronizing system 98. In this embodiment of the door system 10" of the present invention, respective splined output member/door panel pivots 97 are drivingly connected together via any suitable coupling 99, such as a rigid bar, chain, or flexible coupling. The operator 38" may be connected to the output member/door pivots 97 in any suitable fashion, including without limitation using the systems described in published U.S. Patent Application 2003/0005639, by Thomas M. Kowalczyk, and published on Jan. 9, 2003, the entirety of which patent application is hereby incorporated by reference into the present application.

Figure 27:
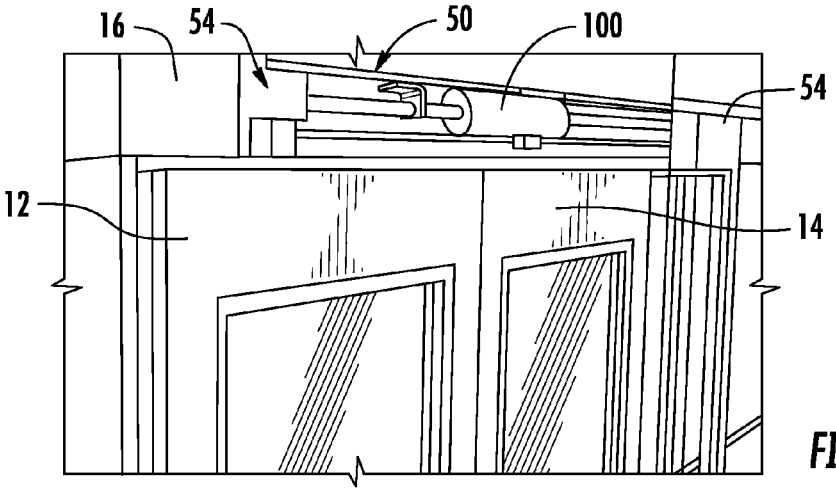
FIG. 27 is a partial perspective detail view of the door system of FIG. 26.
Figure 26:
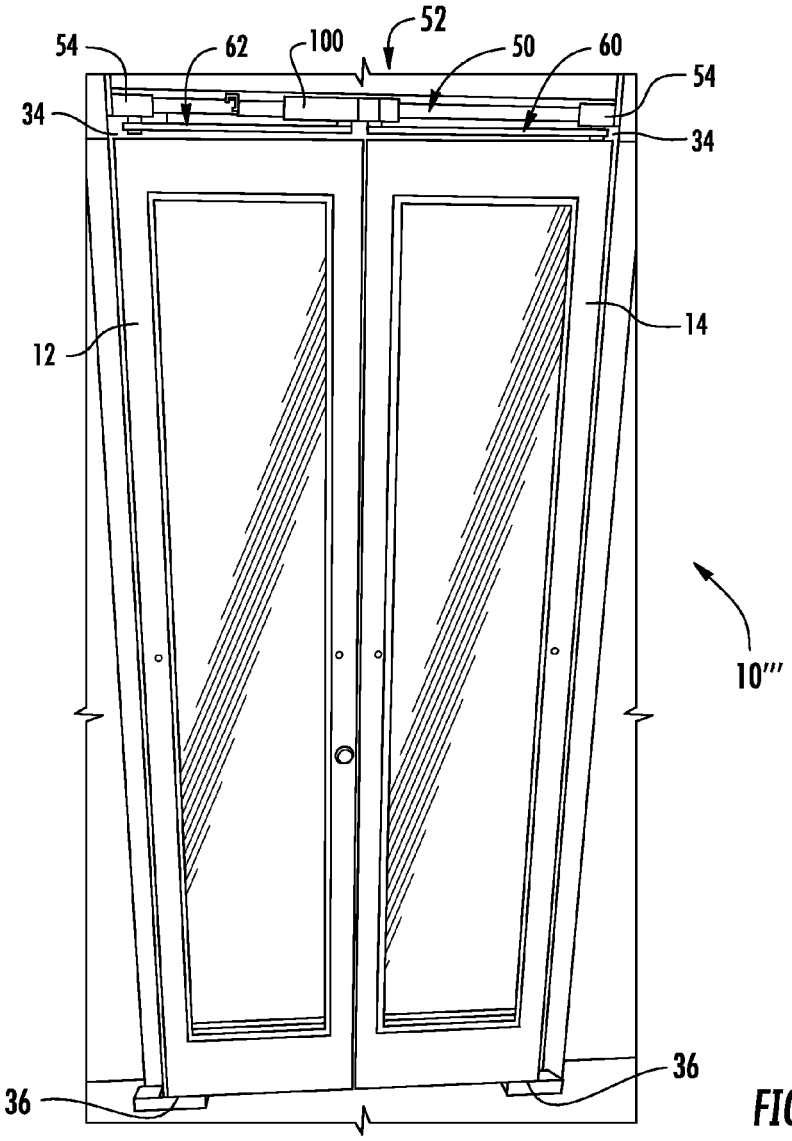
FIG. 26 is a front perspective view of a further embodiment of the door system of the present invention, showing a portion of the header cover removed, and schematically illustrating the use of a mechanical operator with spring.
Figure 28:
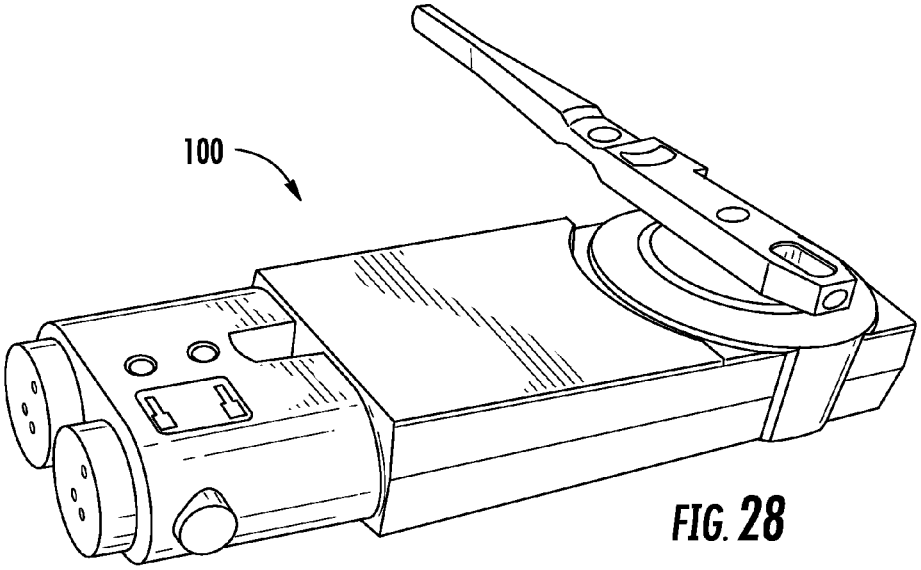
FIG. 28 is a perspective view of a mechanical operator with spring of the type used in the door system shown in FIGS. 26 and 27.

Yet another embodiment of the door system 10'" of the present invention is shown in FIGS. 26 and 27. In this embodiment, the electro-mechanical operator 38 has been replaced in the header 16 by a mechanical operator, namely a door closer with spring 100, such as an International Series 500 Grade 1, 5 LB hydraulic door closer shown in FIG. 28. Here, the output of the door closer 100 has been coupled to the drive disk 46, the linkage system 52 and gearboxes 54 remaining the same. The door panels 12, 14 can be manually opened as previously described; namely, a person simply pushes against a panel and both door panels swing outwardly simultaneously in the direction of travel through substantially the same amount of swing. The door closer 100 (mechanical operator) then returns the door panels 12, 14 simultaneously to their respective home positions. Furthermore, this embodiment is also a bi-directional door system. Even without the use of an electro-mechanical operator, internal tests of this embodiment of the door system 10'" have revealed that the coaction of elements of this invention permit a single-motion emergency breakout of the door system using a manual force of only about three to four pounds.

Figure 29:
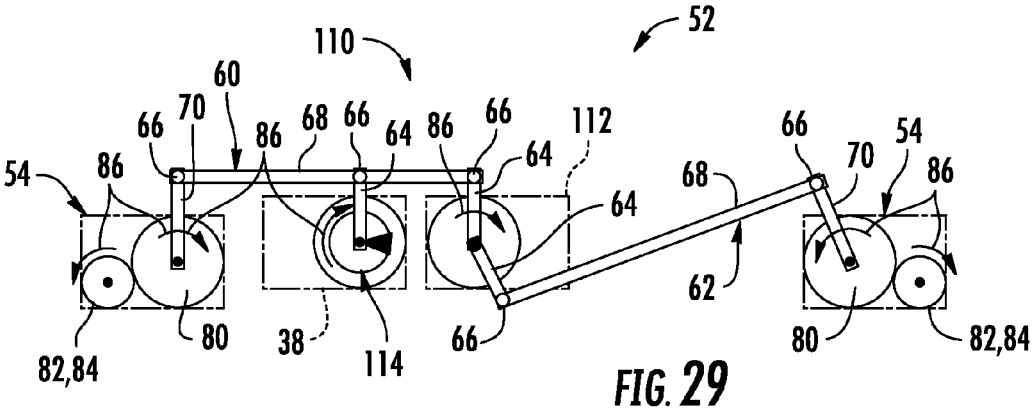
FIG. 29 is a schematic view of a further embodiment of the door system of the present invention shown in the home position and illustrating the use of a hybrid electro-mechanical/mechanical operator system, and further showing the use of a free-motion dog clutch system according to the present invention, where the respective systems are coupled using linkages.
Figure 30:
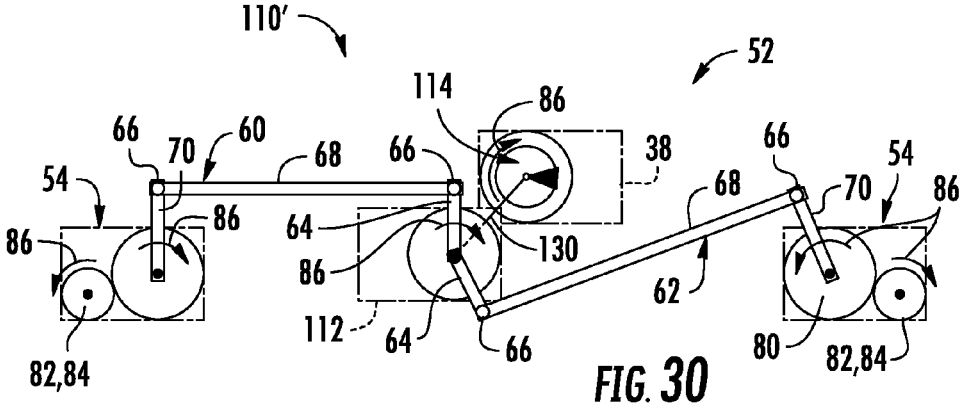
FIG. 30 is a schematic view of a further embodiment of the window system of the present invention, similar to that shown in FIG. 29, but where the free-motion dog clutch system is axially coupled to the mechanical operator with spring.
Figure 31:
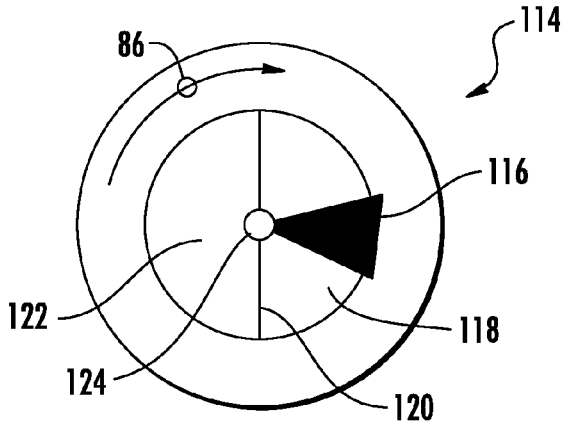
FIG. 31 is an enlarged schematic detail view of the dog clutch system of FIGS. 29 and 30.

If, on the other hand, it is desired to combine the opening attributes of an electro-mechanical operator with the damped closing attributes of a mechanical closer, such as a hydraulic closer with spring, then, as shown schematically in FIGS. 29 and 30, additional embodiments of the door system 110, 110' of the present invention may replace the electro-mechanical operator 38 in the header 16 with a hybrid operator including an electro-mechanical operator 38 and a similar hydraulic door closer with spring 112. In FIG. 29, essentially the same linkage system 52 is used as was used in the previously-described embodiments, with the exception that the electro-mechanical operator or drive 38 is disposed adjacent the output member of the hydraulic door closer with spring 112, and is operatively coupled to the hydraulic door closer with spring 112 and the linkage system 52 with a free-motion dog clutch system 114. Referring now to FIG. 31, where FIG. 31 shows a schematic enlargement of the dog clutch system 114 of FIGS. 29 and 30, the dark segment 116 is the driver element of the dog clutch system 114 and is mounted on, and extends upwardly in a direction perpendicular to the diagram from, a first platform 118. The first platform 118 is located at a first elevation, and the driver element 116 extends upwardly a predetermined height to a second elevation higher than that of the first platform. The first platform 118 is drivingly connected to the output member 44 of the electro-mechanical drive 38. The driver element 116 is thus selectively engageable with a vertical drive face 120 of a second platform 122. Second platform 122 lies at the same elevation as the top of drive element 116, and becomes an output member drivingly connected to hydraulic door closer with spring 112. First and second platforms 118, 122 are coaxially mounted normally for rotation independent of one another about axis 124.

Figure 32:
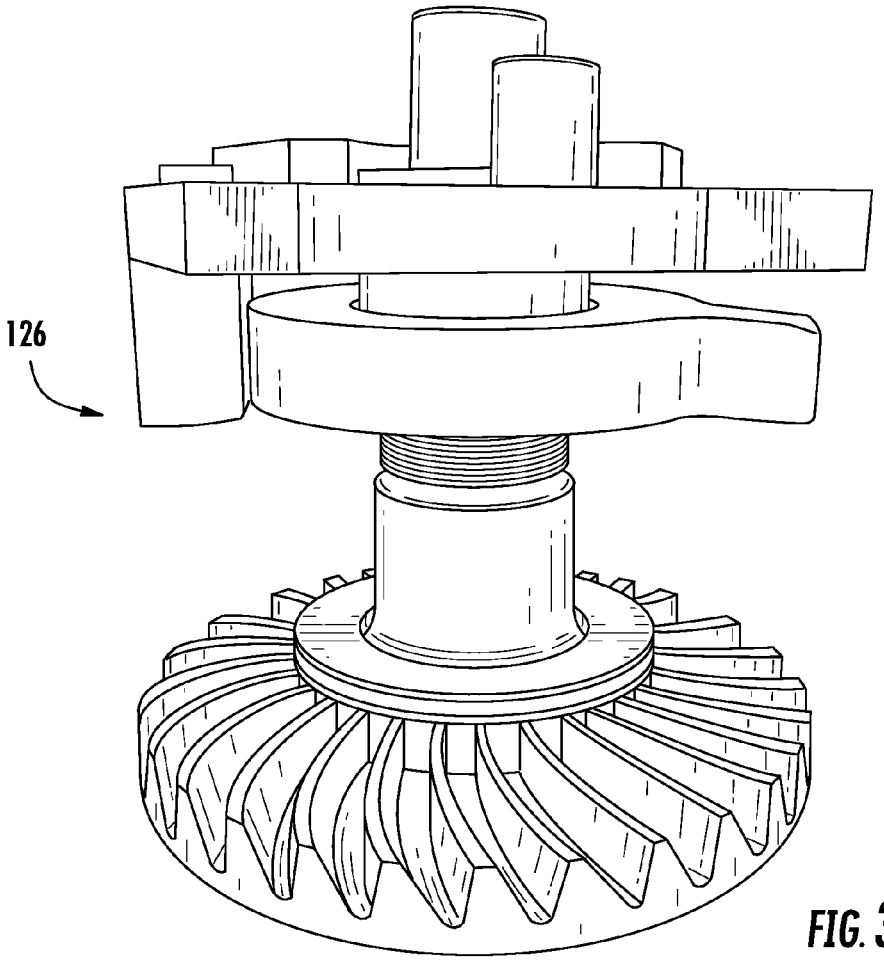
FIG. 32 is a side perspective view of a dog clutch system used in a prior door system.
Figure 33:
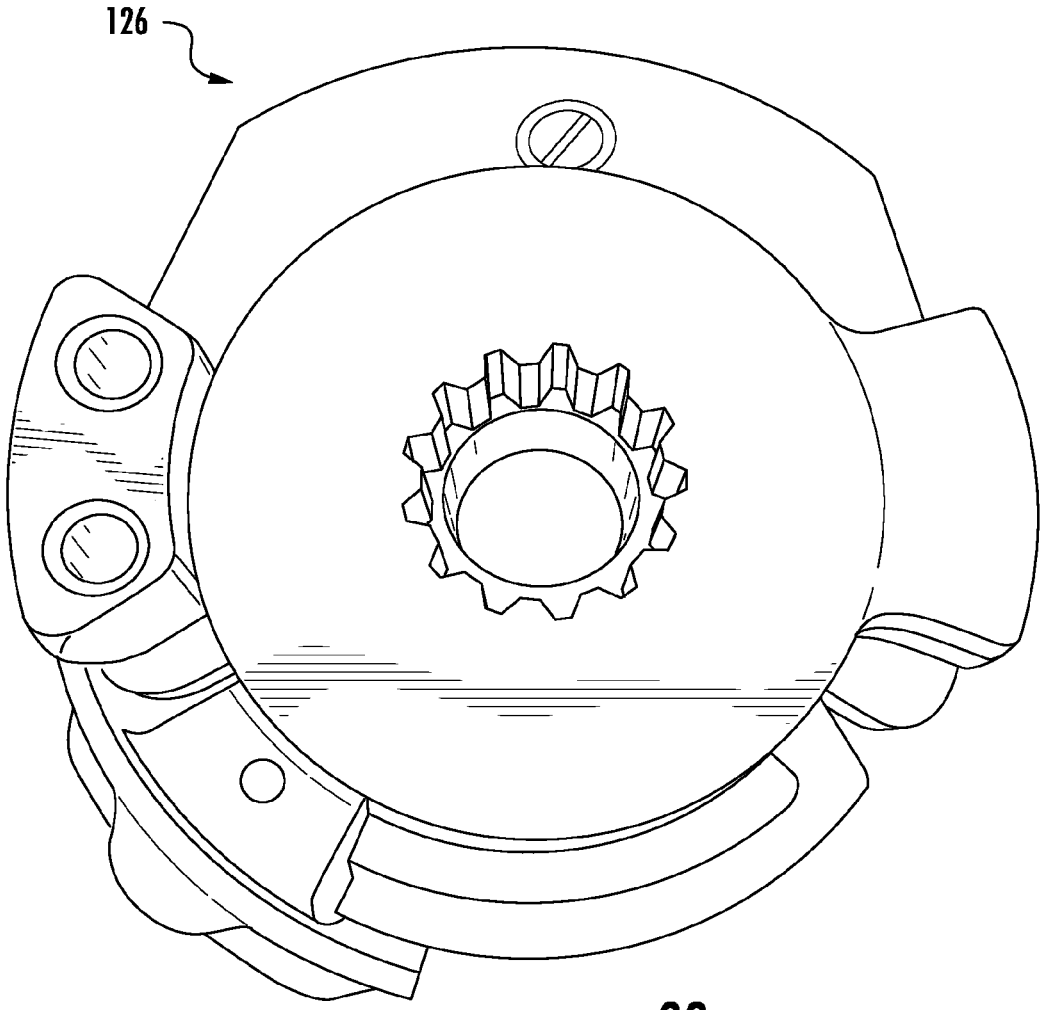
FIG. 33 is a top plan view of certain components of the dog clutch system shown in FIG. 32.

In operation, if a person manually pushes on one of the door panels 12, 14, a 45-degree angular gap in both directions between the drive segment 116 and the drive face 120 of dog clutch system 114 means that the 1:2 motion conversion will allow the door panels to open 90 degrees without back-driving the electro-mechanical drive 38. If, however, the person actuates the electro-mechanical drive 38, the drive segment 116 will rotate 45 degrees before engaging the drive surface 120, but will then ultimately drive the second platform rotationally through 45 degrees and will then stop; the drive segment will then rotate back to its original home position. The door panels 12, 14 will then open through 90 degrees, and will be closed (as driven by linkage system 52) by the normal bias of the hydraulic door closer with spring 112. For more detail on the structure and operation of such a system used for a different purpose, refer to U.S. Pat. No. 8,365,469, issued Feb. 5, 2013 to Kowalczyk et al., the entirety of which patent is hereby incorporated by reference into the present application. By way of example, elements of such similar dog clutches are illustrated at 126 in FIGS. 32 and 33.

FIG. 30 schematically illustrates an embodiment of the hybrid door system 110' of the present invention in which the output of the electro-mechanical drive 38 is disposed coaxially above, and is coaxially drivingly linked to, the output of the hydraulic door closer with spring 112, via connection 130. The rest of the elements remain the same, including the dog clutch system 114.

The above-described embodiments are not to be construed as limiting the breadth of the present invention. Modifications and other alternative constructions will be apparent that are within the spirit and scope of the invention as defined in the appended claims.

What is claimed is:

1. A door system, comprising:

two bi-parting, center-opening, bi-directional door panels disposed for counter-rotating swinging movement in a doorway;

a synchronizing system operatively associated with the door panels;

the synchronizing system being operative to swing the door panels simultaneously selectively outwardly or inwardly of the doorway to open the door panels, and to simultaneously close the door panels, such that the door panels swing through substantially equal angular distances during opening and closing;

wherein the synchronizing system including a linkage system, and further including two motion converters, the linkage system and motion converters being operatively associated with the door panels;

the linkage system including first and second linkages, each defining a driven link;

each motion converter being drivingly connected to a respective door panel and being operative to convert the motion of respective driven links to rotary motion; such that rotation of one door panel through a predetermined angular distance, whether inwardly or outwardly of the doorway, simultaneously rotates the other door panel through substantially the same angular distance;

wherein the first and second linkages lying in the same plane;

each of the first and second linkages defining a driver link pivotably connected to a connecting link, which in turn is pivotably connected to a respective driven link; such that the driver and driven links of the first linkage remaining in parallel throughout the operation of the synchronizing system, and the connecting link of the second linkage being disposed at an angle to the connecting link of the first linkage, such that the driven link of the second linkage rotates in a direction opposite to the direction of rotation of the driven link of the first linkage.

2. The door system claimed in claim 1, wherein the synchronizing system further being operative to simultaneously open the door panels through substantially equal angular distances by a person manually contacting one of the door panels.

3. The door system claimed in claim 1, wherein the synchronizing system further being operative to swing the door panels responsive to an operator, the operator being one of an electro-mechanical operator and a mechanical door closer with spring.

4. The door system claimed in claim 1, wherein the synchronizing system further being operative to swing the door panels responsive to an operator which is a hybrid of an electro-mechanical operator and a mechanical door closer with spring.

5. The door system claimed in claim 1, wherein:

a drive having a drive output member is rotatably connected to the driver links such that rotation of the drive output member rotates both door panels simultaneously through a predetermined angular distance in either direction relative to the doorway.

6. The door system claimed in claim 5, wherein; each motion converter including a gearbox;

the gearbox having an input gear having an axis and being drivingly connected to an output gear, the output gear having an axis offset from that of the input gear; and the driven links being pivotably connected to respective input gears.

7. The door system claimed in claim 6, wherein the gear ratio is such that rotation of the drive output member through 45 degrees causes the door panels to rotate through 90 degrees.

8. The door system claimed in claim 7, wherein the drive output member may be rotated through 90 degrees, thereby enabling rotation of the door panels through a total swing of 180 degrees.

9. A door system for a doorway having a predetermined width, comprising:

a header disposed in an upper portion of the doorway and having first and second ends;

first and second center-opening door panels disposed for swinging movement in the doorway beneath the header;

two door panel pivot members extending downwardly from the header, each being disposed adjacent respective ends of the header;

each door panel being drivingly connected to, and being pivotal about, respective door panel pivot members;

a synchronizing system disposed in the header and being operative to swing the first and second door panels simultaneously through substantially equal angular distances to open the door panels, and to simultaneously close the door panels; wherein rotation of one of the door panels through a predetermined angular distance causes the other door panel to simultaneously rotate through substantially the same angular distance; and an operator disposed in the header and being drivingly connected to the synchronizing system;

the operator defining a rotatable output member disposed intermediate the ends of the header; wherein the synchronizing system including first and second linkages lying in the same plane, each linkage including a driver link connected to the operator output member, a connecting link pivotably connected to the driver link, and a driven link pivotably connected to the connecting link, such that rotation of the driver link in one direction causes one driven link to rotate in the same direction and the other driven link to rotate in the opposite direction.

10. The door system claimed in claim 9, wherein rotation of the operator output member through a predetermined angular distance causes the door panels to rotate through substantially the same predetermined angular distance.

11. The door system claimed in claim 9, wherein:

the synchronizing system further being operable to selectively swing both door panels simultaneously either inwardly and outwardly of the doorway to open the door panels, and to simultaneously close the door panels;

the synchronizing system further including a gearbox disposed in the header adjacent to each end of the header and being operatively associated with a respective door panel pivot member and driven link; and the gearbox having a predetermined gear ratio such that rotation of the operator driven member through an angular distance of 45 degrees in either direction causes the door panels to rotate 90 degrees outwardly or inwardly of the doorway, respectively.

12. The door system claimed in claim 11, wherein:

the operator includes an electro-mechanical operator having a motor connectable to a source of electrical power, the motor being drivingly connected to the operator output member through a transmission; and further comprising:

a controller disposed in the header and being operatively associated with the operator to cause the operator to rotate the door panels selectively inwardly or outwardly of the doorway.

13. The door system claimed in claim 12, wherein a person may manually open both door panels simultaneously by pushing against one of the door panels with a single motion.

14. The door system claimed in claim 13, wherein the pushing force necessary to open the door panels is from about two pounds to about three pounds.

15. The door system claimed in claim 11, wherein:

the operator is a mechanical door closer with spring; and the door panels may be normally opened by a person exerting a manual force against one of the door panels in the range from about two pounds to about five pounds.

16. The door system claimed in claim 15, wherein the mechanical door closer with spring includes a hydraulic door closer.

17. The door system claimed in claim 11, wherein:

the operator is a hybrid of an electro-mechanical operator and of a mechanical door closer with spring; and further comprising:

a dog clutch system coupling the electromechanical operator and the mechanical door closer with spring such that, if a person were to manually push against one of the door panels, both door panels will open up to 90 degrees without back-driving the electro-mechanical operator, but where the electro-mechanical operator can still be used to open the door panels, and the mechanical door closer with spring can still be used to close the door panels.

18. The door system claimed in claim 9, wherein at least one connecting link has an adjustable length.

19. The door system claimed in claim 9, wherein:

the operator output member rotates about an axis substantially centered in the header; and further comprising:

a drive disk drivingly connected to the output member about said axis; wherein the driver links are disposed on opposite portions of the drive disk.

20. The door system claimed in claim 19, further comprising:

an adjustable stop disposed in the header and operatively associated with the drive disk to limit rotation of the drive disk; whereby the opening swing of the door panels may be adjusted to lie in the range from about 90 degrees to about 110 degrees, while enabling the closing swing to be substantially 90 degrees.

* * * * *